US005096176A

United States Patent [19]

Golicz et al.

[11] Patent Number: 5,096,176

[45] Date of Patent: * Mar. 17, 1992

[54] SHEET SET SEPARATION USING FOLDED STRIPS

[75] Inventors: Roman M. Golicz, Clinton; Todd R. Holland, Scotland, both of Conn.

[73] Assignee: Pitney Bowes Inc., Stamford, Conn.

[ * ] Notice: The portion of the term of this patent subsequent to Feb. 18, 2009 has been disclaimed.

[21] Appl. No.: 632,805

[22] Filed: Dec. 24, 1990

[51] Int. Cl.[5] ..... B65H 33/04

[52] U.S. Cl. ..... 270/95; 414/789.5

[58] Field of Search ..... 270/58, 59, 95, 32, 270/45; 414/789.5, 790.8; 271/215, 217, 218

[56] References Cited

U.S. PATENT DOCUMENTS

| | | | |
|---|---|---|---|
| Re. 23,641 | 4/1953 | Andren | 414/789.5 |
| 2,052,615 | 9/1936 | Foellmer . | |
| 2,621,737 | 12/1952 | Ledig . | |
| 2,795,172 | 6/1957 | Hanson . | |
| 2,837,016 | 6/1958 | Jezierski . | |
| 3,128,219 | 4/1964 | Cummings . | |
| 3,205,739 | 9/1965 | Meyer-Jagenberg | 270/95 |
| 3,458,186 | 7/1969 | Schmidt . | |
| 3,466,983 | 9/1969 | Meyer-Jagenberg | 270/95 |
| 3,860,127 | 1/1975 | Fassman . | |
| 3,902,646 | 9/1975 | Kuhns . | |
| 3,911,517 | 10/1975 | Davis . | |
| 4,017,066 | 4/1977 | Lasher et al. . | |
| 4,586,232 | 5/1986 | Ohmura et al. . | |
| 4,611,736 | 9/1986 | Gavronsky et al. . | |

FOREIGN PATENT DOCUMENTS

| | | | |
|---|---|---|---|
| 27861 | 2/1982 | Japan | 270/95 |

*Primary Examiner*—Edward K. Look
*Assistant Examiner*—Therese M. Newholm
*Attorney, Agent, or Firm*—Charles R. Malandra, Jr.; David E. Pitchenik; Melvin J. Scolnick

[57] ABSTRACT

Apparatus and a method are disclosed for associating a strip with a set of stacked sheets. The strip, which may be paper tape, is positioned intersecting a path along which a set of sheets such as paper sheets is advanced. The sheet set is advanced towards the strip so that the downstream edge of the sheet set engages the strip with portions of the strip extending substantially beyond opposed major sides of the sheet set. The strip is then folded at least once to the sheet set adjacent the downstream edge of the sheet set with the strip portions extending generally adjacent the major sides of the sheet set. The strip is folded by advancing the sheet set and the strip through a nip. The strip is indexed from a roll to the position in the path of the sheet set. The strip is tensioned and is drawn against a knife edge as the sheet set advances through the nip to sever the strip from the roll.

26 Claims, 4 Drawing Sheets

SHEET SET SEPARATION USING FOLDED STRIPS

BACKGROUND OF THE INVENTION

The invention disclosed herein relates to separating sets of sheet material, for example, sets of paper sheets in paper processing apparatus such as copiers and mailing machines. More particularly, the invention relates to associating strips of material with sets of sheet material to separate the sets.

One technique for separating sets of one or more stacked sheets is to offset the sheet sets. See, for example, U.S. Pat. Nos. 3,860,127 (Fassman) and 4,017,066 (Lasher et al.). One drawback of this sheet set separation technique is that the offset is easily lost and that the once-separated sheet sets are easily mingled.

Another technique positions one or more strips of paper between the adjacent sheet sets to be separated. According to this technique, a strip loosely lies between the first and last sheets of the sets to be separated, i.e., the strip is not adhered or affixed to the sheets in any way and becomes engaged solely by virtue of being between adjacent sheets of adjacent sets. See, for example, U.S. Pat. Nos. 2,052,615 (Foellmer), 2,795,172 (Hanson), 2,837,016 (Jezierski) and 3,458,186 (Schmidt). One drawback of this technique is that the strips easily fall out or the strips are easily moved so they are not easily visible from the exterior of a stack of sheet sets. Typically, this technique involves advancing the strip from a roll thereof, inserting the strip adjacent the first or last sheet of a set, severing the strip from the roll and moving the next sheet from the adjacent set into position adjacent the inserted strip, although not necessarily in the order described.

In the patents cited above in connection with positioning a strip between sets of sheets to be separated, the strip is advanced from a roll thereof and severed therefrom. U.S. Pat. Nos. 2.621,737 (Ledig), 3,128,219 (Cummings), 3,902,646 (Kuhns), 3,911,517 (Davis) and 4,611,736 (Gavronsky et al.) disclose strip or tape dispensing apparatus in which a strip or tape is withdrawn from a roll, severed therefrom and adhered to a sheet. In these four patents, however, the strip is adhered to a sheet of a sheet set, not for separating a sheet set, but for binding the sheets of a set together, or is adhered to a sheet for other reasons. U.S. Pat. No. 4,586,232 (Ohmura et al.) discloses wrapping bundles with shrink wrapping film withdrawn and severed from a roll thereof, in which the film is positioned in the path of an advancing bundle where it is engaged by and drawn around the advancing bundle.

SUMMARY OF THE INVENTION

It is an object of the invention disclosed herein to provide an improved technique for separating or identifying sets of one or more stacked sheets.

It is another object of the invention to utilize strips of material, e.g. paper, to separate sets of stacked sheets, but in doing so to more securely associate the strips with the separated sets without adhering the strips to any sheet using an adhesive or by piercing the sheet, etc.

It is another object of the invention to provide improved strip dispensing and inserting apparatus and methods for achieving the above objects.

The above and other objects are achieved in accordance with the invention by applying a strip of material to a sheet set so the strip extends along one major side of the set, about the set edge, and along the opposite major side of the set. In accordance with the invention, the strip is folded at least once at the set edge. In the preferred embodiment, the strip is folded twice, once at one major side and again at the opposite major side. Applying a strip about the sheet edge of the set reduces the risk of the strip moving completely between adjacent sets so as not to be visible from a stack of sheet sets, and folding the strip at least once at the sheet set edge reduces the risk that the strip will be separated from the sheet set. Folding the strip twice, once at the edge of each end sheet in the set, causes the strip to extend a substantial distance along and parallel to each major side of the sheet set, and more securely holds the strip against the set to reduce even further the risk that the strip may separate from the sheet set.

In a specific embodiment, a strip of material such as paper is positioned intersecting a path along which a set of sheets such as paper sheets is advanced, and the sheet set is advanced towards the strip so that the downstream edge of the sheet set engages the strip with portions of the strip extending substantially beyond opposed major sides of the sheet set. The strip is then applied, e.g., by folding the strip at least once, to the sheet set adjacent at least the downstream edge of the sheet set with the strip portions extending generally parallel to and adjacent the major sides of the sheet set as the sheet set moves past the strip. The strip is sized so that after application thereof to the sheet set, the strip extends along substantial portions of the major sides of the sheet set.

Relative motion between the strip and the sheet set in the preferred embodiment is accomplished by advancing the sheet set towards a stationary strip. However, such relative motion may be obtained by moving the strip towards a stationary sheet set or by moving both the sheet set and the strip towards each other.

In a specific embodiment, the strip is folded about the downstream edge of the sheet set by advancing the sheet set and the strip engaged by the downstream edge thereof into a nip ("folding nip") of rolling means, e.g., means for folding the strip at least once adjacent the downstream edge of the sheet set. In the preferred embodiment, the folding means comprises opposed rollers, such that the rolling means folds the strip at each of the major sides as the strip is carried through the rolling means. Preferably, the rolling means comprises opposed rollers (or pulleys) at least one of which is driven to continue or assist in continuing the advance of the sheet set in the path. Preferably, the sheet set is engaged by additional rollers, belts, etc., to advance the sheet set through and past the folding nip.

In a preferred embodiment, the strip is advanced from a roll thereof such that the strip has a free end extending substantially beyond a first major side of the sheet set and is attached to the roll at a point substantially beyond a second major side of the sheet set. The strip is attached to the roll as the downstream edge of the sheet set engages the strip, and is severed from the roll after the strip is engaged by the downstream edge of the sheet set. Severing may be accomplished by drawing the strip across a cutter when the strip and sheet set downstream edge are engaged and advance in the folding nip.

A specific embodiment of apparatus in accordance with the invention for applying a strip of material to a set of stacked sheets comprises means for holding a strip of material in a path along which a sheet set is being advanced; means for advancing the sheet set towards and past the strip such that the downstream edge of the sheet set engages the strip with portions of the strip extending beyond first and second opposed major sides of the sheet set; and means for folding the strip at least once adjacent the downstream edge the sheet set. As mentioned, preferably the strip is folded twice, once at each of the major sides, such that the strip portions extend generally parallel to and adjacent the major sides.

A specific embodiment of the folding means comprises the folding nip referred to above which is formed by a pair of rollers into which the sheet set downstream edge and the strip engaged thereby are advanced The rollers engage the sheet set and the strip and fold the strip at the downstream edges of the major sides. Preferably, means are provided for driving at least one of the rollers such that the rollers engage the sheet set and strip and continue or assist in continuing the advance of the sheet set along the path.

In the preferred embodiment, a first roller of the pair comprises a first pulley and a first belt passing around the first pulley. A second belt passes over the second roller in generally tangential contact therewith. The folding nip is formed by the first belt where it passes around the first pulley and by the second belt where it passes over the second roller. The second roller is resiliently mounted to move under the action of a spring bias towards and away from the first belt. Means are provided for driving the first belt to thereby drive the first pulley. The second belt preferably also is driven in synchronism with the first belt, preferably by the driving means for the first belt.

In the preferred embodiment, the strip is advanced or indexed from a roll, and the apparatus comprises means for advancing strip material from the roll into the path of the advancing sheet set such that a free end of the strip extends substantially beyond the first major side and a substantial portion of the strip connected to the roll extends beyond the second major side. Means are provided for severing the substantial portion of the strip from the roll after the strip has been engaged by the sheet set downstream edge. The severing means may comprise a stationary knife edge positioned adjacent and spaced from the substantial portion of the strip when the strip is held in the path, and means for guiding the substantial portion of the strip against the knife edge as the sheet set and the strip advance through the folding nip. The guiding means comprises means for resiliently tensioning the strip as the strip is guided towards the knife edge.

In a preferred embodiment, the tensioning means comprises a flexible sheet along which the strip is advanced from the roll. The sheet is fixed at an upstream end thereof while the downstream end of the sheet is free and movable towards the knife edge. The sheet flexes towards the knife edge when the strip is advanced by its engagement with the downstream edge of the advancing sheet set.

In a preferred embodiment the strip advancing means comprises third and fourth rollers disposed to form a nip positioned to receive the strip from the roll. At least one of the third and fourth rollers is selectively driven, preferably by selective coupling to a driven part which advances the sheet set or folds the strip. In the preferred embodiment, one of the third and fourth rollers is selectively driven from a belt which assists in folding the strip and/or advancing the sheet set.

BRIEF DESCRIPTION OF THE DRAWINGS

The invention is illustrated by way of example and not limitation in the figures of the accompanying drawings in which like references denote like or corresponding parts, and in which.

DESCRIPTION OF THE PREFERRED EMBODIMENTS

Figure 1:
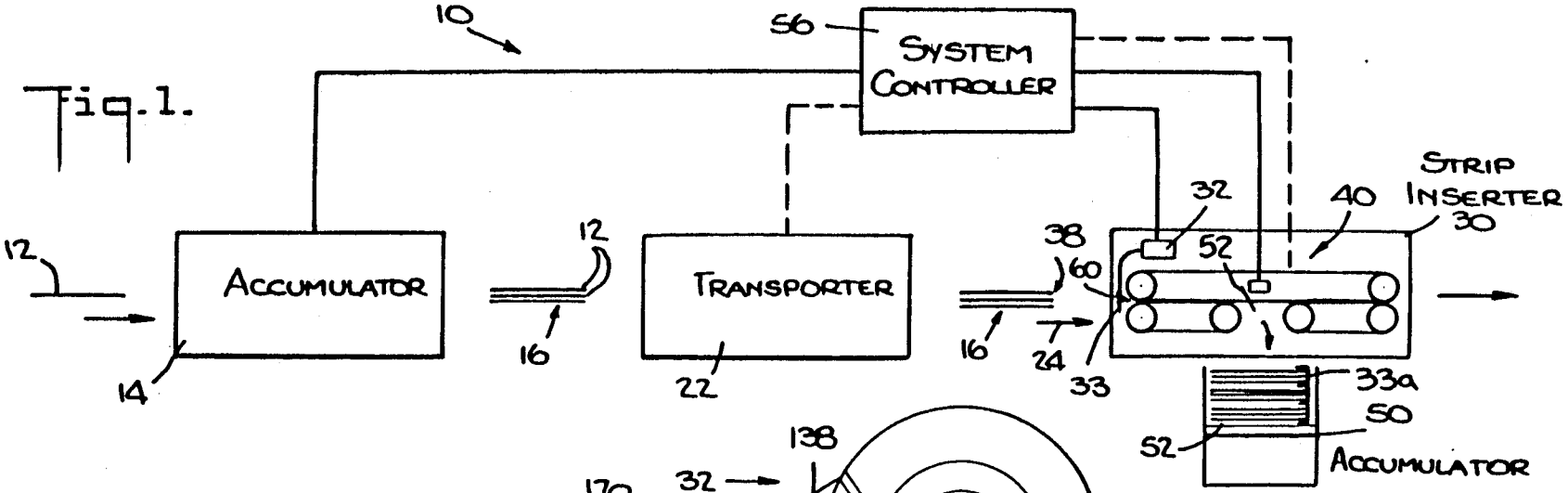
FIG. 1 is a block diagram of a paper processing system incorporating strip inserting apparatus for sheet set separation according to the invention.

Referring to FIG. 1, a paper processing system 10 transports sheets 12 of paper from, for example, a photocopying station (not shown) towards an accumulator 14 where they are stacked into sheet sets 16. The number of sheets 12 to be accumulated in each sheet set 16 may vary, and may be determined conventionally. After exiting accumulator 14, the sheet sets 16 are advanced by a transporter 22 along a path 24 towards and into a strip inserter 30 according to the invention. Strip inserter 30 includes a strip advancer 32 which advances a strip 33 of paper (sometimes referred to as tape) from a roll 34 (FIG. 2) thereof into the path 24 of an advancing set 16, folds the strip around the downstream edge 38 of the sheet set 16 and severs the folded strip 33*a* from the roll 34.

Strip inserter 30 includes a diverter 52 which either diverts sheet sets 16 with folded strips 33*a* applied thereto into stack accumulator 50, or allows sheet sets of one or more sheets 12 without a folded strip 33*a* to advance to a downstream transporter or an accumulator (not shown). Accumulator 50 has a platform 52 which is indexed downwardly each time it receives a sheet set 16 to thereby accommodate a number of stacked sheet sets 16. System 10 includes a system controller 56 which controls sheet accumulation in accumulator 14, advancing of strip material 33 by strip advancer 32 and the positioning of diverter 52 in strip inserter 32. Transporter 22 and strip folder 40 which continues the advance of a sheet set 16 therethrough, may run continuously, i.e., whenever system 10 is active, or intermittently under control of system controller 56. System controller 56, accumulator 14 and transporter 22 may be conventional.

Figure 2:
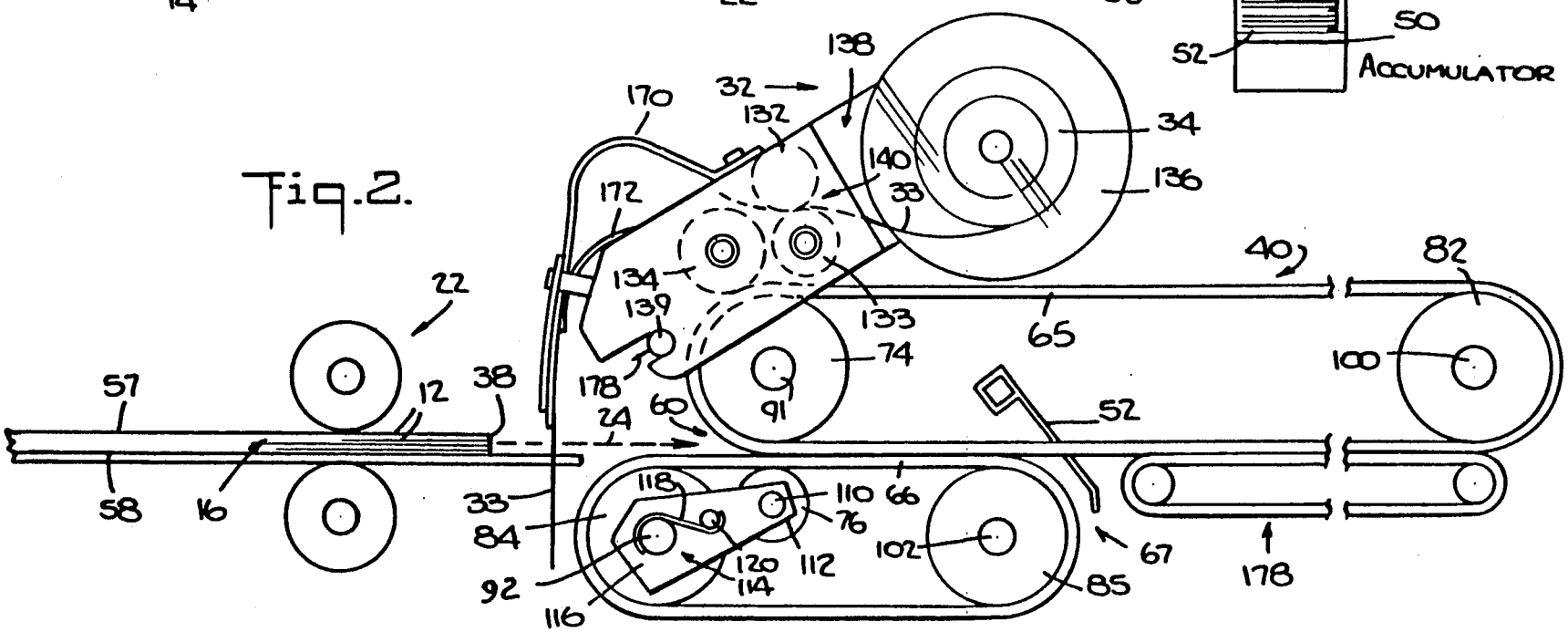
FIG. 2 is a generally schematic side view of the strip inserting apparatus according to the invention showing the strip positioned in the path of and about to be engaged by an advancing set of stacked sheets.
Figure 4:
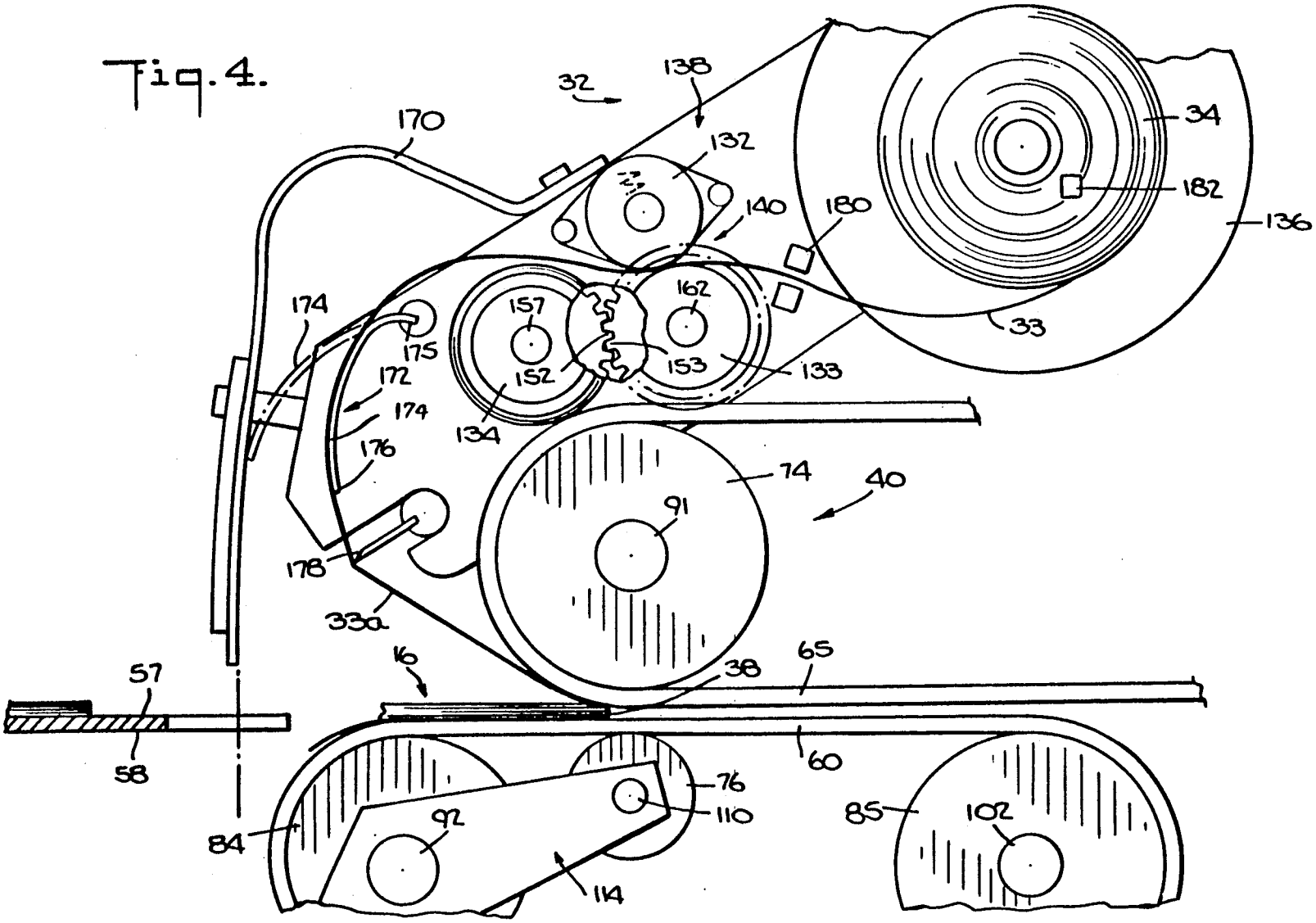
FIG. 4 is a side sectional view of a portion of the strip inserting apparatus of FIG. 3 showing the strip material engaged by the downstream edge of the advancing sheet set and being drawn against a knife edge.

FIGS. 2 and 4 illustrate a sequence in which a sheet set 16 is advanced along path 24 towards a strip 33 positioned intersecting path 24 (FIG. 2), and in which the downstream edge 38 of advancing sheet stack 16 engages strip 33 and carries it to a strip folder 40 in strip inserter 30 which folds the strip 33 into the strip 33*a* (FIG. 4). A folding nip formed at 60 in strip folder 40 receives the downstream edge 38 of sheet set 16 and a strip 33 engaged by the advancing sheet set edge 38, and folds the strip 33 around the sheet set edge 38 as the set is advanced along path 24 into strip folder 40. The strip 33 is folded so that substantial portions extend along and parallel to opposed major sides 57, 58 of sheet set 16.

Figure 3:
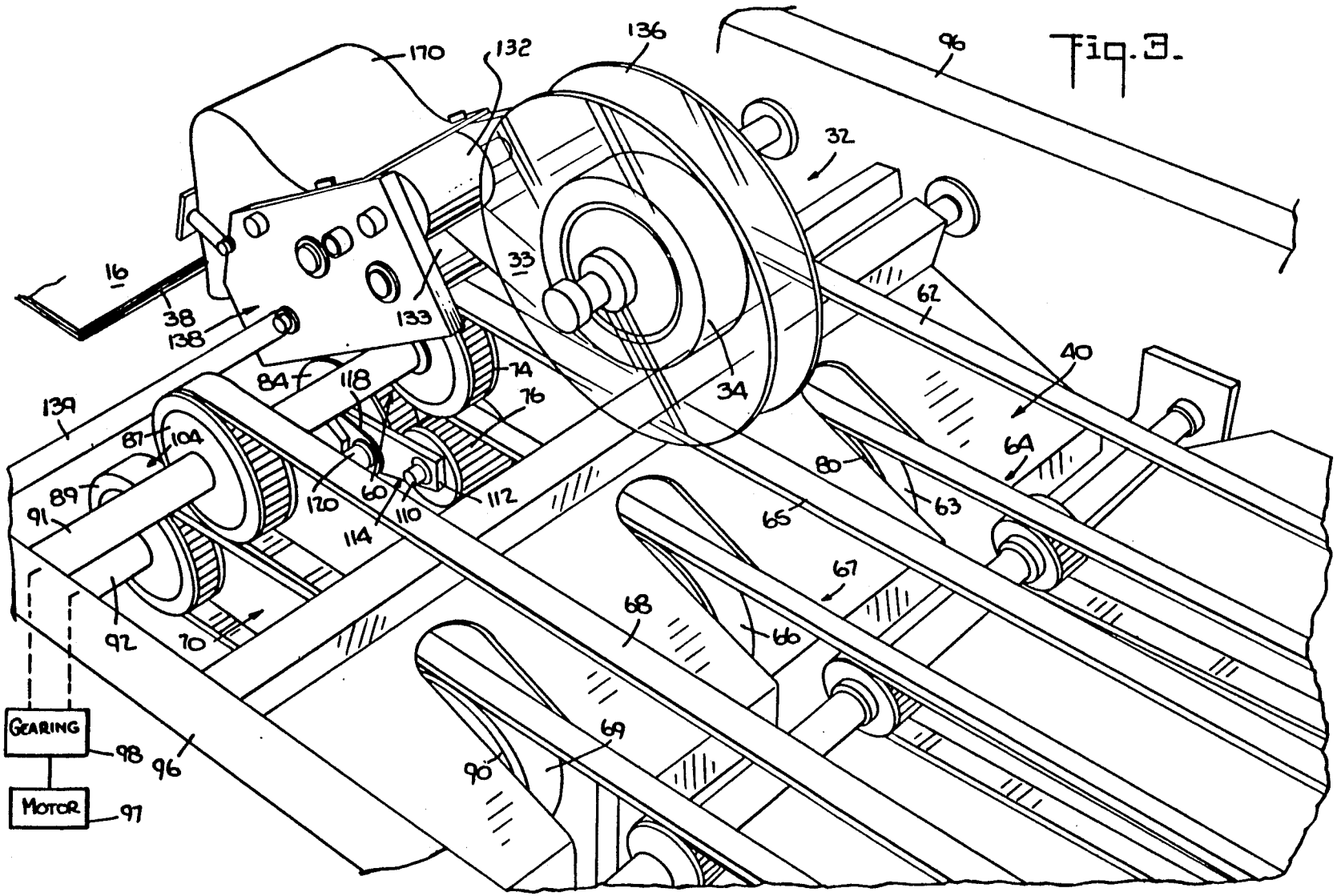
FIG. 3 is a top perspective view of the strip inserting apparatus depicted in FIG. 2.

As shown in FIG. 3, strip folder 40 comprises three laterally-spaced pairs of upper and lower endless belts, 64, 67 and 70. Upper belt 62 and lower belt 63 form an outer pair 64; upper belt 65 and lower belt 66 form an intermediate pair 67; and upper belt 68 and lower belt 69 form another outer pair 70. The upper and lower belts of each pair are supported generally superposed and aligned with the runs thereof directly opposite and closely adjacent each other. The upper belts of the belt pairs are aligned and the lower belts of the belt pairs are aligned such that the three pairs of belts 64, 67, 70 define a common run for sheets 12 or sheet sets 16 which lies in a common plane between the upper and lower belts. The upper and lower belts of the respective pairs cooperate to engage and advance a paper sheet 12 or a sheet set 16 through the strip folder 40. As described in greater detail below, belts 65 and 66 of the intermediate pair (FIG. 3) form the folding nip 60 and in cooperation with pulley 74 and pulley 76 fold the strip 33 around the downstream edge 38 of sheet set 16 as the sheet set is advanced through the strip folder 40. The first roller referred to above comprises pulley 74 and belt 65 where it passes over pulley 74, and the second roller referred to above comprise pulley 76 and belt 66 where it passes over roller 76, which comprise the presently preferred folding means referred to above.

Upper outer belt 62 is supported by upstream and downstream upper pulleys which are not visible in the drawings; lower outer belt 63 is supported by upstream and downstream lower pulleys, only the lower downstream pulley 80 of which is visible in the drawings (FIG. 3); intermediate upper belt 65 is supported by upstream and downstream upper pulleys 74 and 82 (FIG. 2), respectively; lower intermediate belt 66 is supported by upstream and downstream lower pulleys 84 and 85, respectively; outer upper belt 68 is supported by upstream and downstream upper pulleys, only the upper upstream pulley 87 of which is visible in the drawings (FIG. 3); and outer lower belt 69 is supported by upstream and downstream lower pulleys 89 and 90, respectively. The upper upstream pulleys for belts 62, 65 and 68 are fixed to an upper upstream shaft 91 to rotate therewith, and the lower upstream pulleys for belts 63, 66 and 69 are fixed to a lower upstream shaft 92 to rotate therewith. Upstream shafts 91 and 92 are supported on opposite ends from frame 96 by bearings and are driven from a common motor 97 via gearing 98. Motor 97 may be run continuously or intermittently under control of system controller 56. The upper downstream pulleys for belts 62, 65 and 68 are fixed to upper downstream shaft 100 (FIG. 2) to rotate therewith, and the lower downstream pulleys for belts 63, 66 and 69 are fixed to lower downstream shaft 102 to rotate therewith. Downstream shafts 100 and 102 are supported by bearings from frame 96 but are not driven.

Outer upper upstream pulley 87 is slightly offset to the downstream side of outer lower upstream pulley 89, and the other outer upper upstream pulley (not shown) is slightly offset to the downstream side of the other outer lower upstream pulley (not shown). This offset causes the nip 104 of outer belts 68 and 69 to be formed adjacent a portion of lower belt 68 that is not passing over lower pulley 89. Thus, nip 104 is not rigid as it would be if it was formed by aligned upper and lower pulleys 87 and 89, but is flexible due to the flex in lower belt 69 to provide a variable height opening to the nip 104 to accommodate sheet sets of different heights. A similar variable height nip opening is provided between outer upper and lower belts 62 and 63.

Folding nip 60 to intermediate belts 65 and 66 is similarly offset from lower upstream pulley 84 to a downstream position adjacent pulley 76. Pulley 76 is rotatably supported on a shaft 110 via bearings mounted to the downstream ends 112 of arms 114. The upstream ends 116 (FIG. 2) of arms spaced 114 are pivotably mounted to lower upstream shaft 92. A spring 118 fixed to shaft 92 bears against projection 120 extending from one of the arms 112 to resiliently urge pulley 76 counterclockwise towards upper upstream pulley 74. Spring 118 is selected so that pulley 76 may be pivoted clockwise against the action of spring 118 as sheet sets of different heights enter nip 60 to provide a variable height nip opening. Spring 118 is also selected so that it urges pulley 76 against upper belt 65 and upper pulley 74 with sufficient force to fold a strip 33 around the downstream edge 38 of a sheet set 16 which is advanced into nip 60 (FIG. 4). Belts 65 and 66 sandwich a cut strip 33*a* and a sheet set 16 therebetween and maintain strip 33*a* against the major sides of the sheet set as the sheet set is advanced towards accumulator 50.

Thus, the belts and pulleys of strip folder 40 cooperate to advance a sheet set 16 through the strip folder 40 while roller 76 and belt 66 cooperate with pulley 74 and belt 65 to fold a strip 33 around the upstream edge 38 of a sheet set advanced into nip 60.

Referring to FIGS. 2–4, strip inserter 30 includes a strip dispenser 32 comprising rollers 132–134 and a reel 136 for a roll 34 of strip material, all mounted on a frame 138 rotatably mounted to a shaft 139 fixed to frame 96. Frame 138 in its unpivoted position rests under its own weight and the moment generated from pivoting about shaft 139 with roller 134 engaging upper intermediate belt 65. The entire strip dispenser 32 including rollers 132–134 and reel 136 may be pivoted away from the strip folder 40. This provides easy access to the strip folder 40 and to the strip dispenser 32 for clearing jams, servicing, inserting new rolls 34 of strip material and repair.

Figure 5:
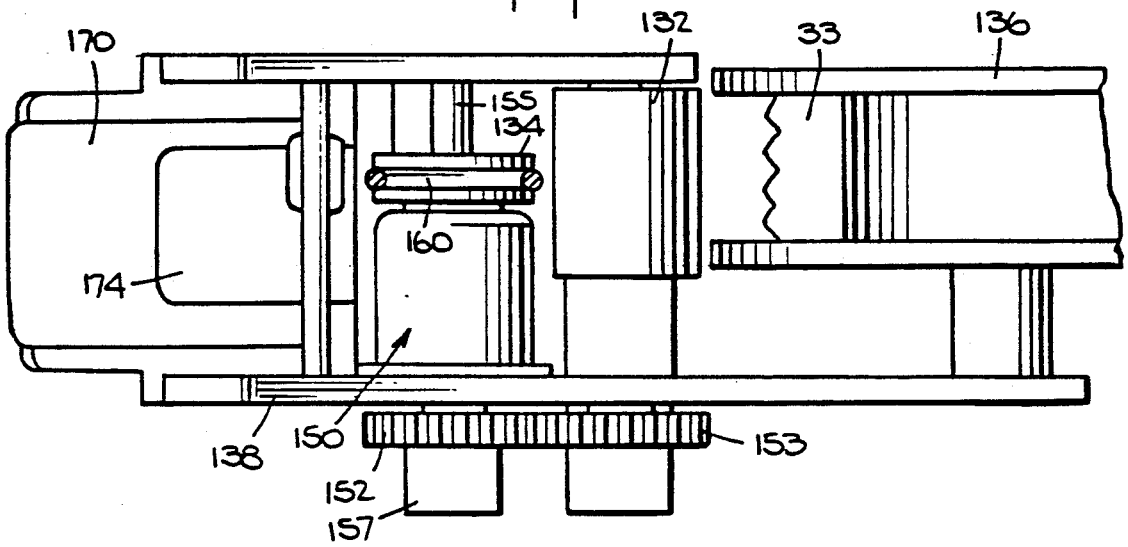
FIG. 5 is a top view of the strip dispensing portion of the strip inserting apparatus of FIG. 2.
Figure 6:
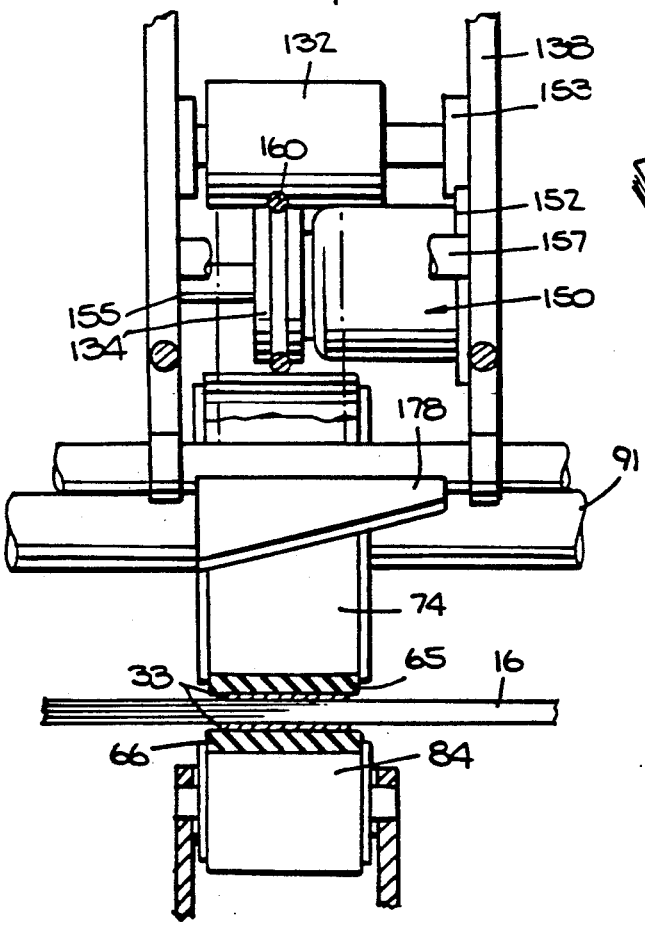
FIG. 6 a front cross section view of the strip dispensing apparatus depicted in FIG. 5 and the lower portion of the strip inserting apparatus.

Reel 136 is supported from frame 138 to rotate when tension is put on strip material 33 so that strip material may be withdrawn from reel 136. Roller 132 (third roller) and roller 133 (fourth roller) are rotatably supported closely adjacent each other from frame 138 to from a nip 140 through which strip material 32 is fed. Roller 132 is an idler roller, and roller 133 is driven by roller 134 (fifth roller), clutch 150 (FIG. 5) and gears 152, 153 as follows to withdraw tape from reel 136. Referring to FIGS. 5 and 6, clutch 150 includes a rotatable input shaft 155 rotatably mounted at its free end to frame 138 by a bearing. Roller 134 is fixed to input shaft 155 supported closely adjacent intermediate upper pulley 74 of strip folder 40. Clutch 150 also includes a rotatable output shaft 157 rotatably mounted to frame 138 by a bearing. Clutch 150 selectively couples rotation of input shaft 155 (FIGS. 5-6) to output shaft 157 upon unclutching of clutch 150 by a control signal from system controller 56 (FIG. 1).

An O-ring 160 is fixed to roller 134 about the circumference thereof to rotate therewith. O-ring 160 is engaged by intermediate upper belt 65 where it passes around upper pulley 74 so that rotation of upper belt 65 causes roller 134 and input shaft 155 to rotate. Gear 152 is fixed to output shaft 157 and gear 153 is fixed to the shaft 162 of roller 133 (see FIG. 4) to rotate therewith in mesh with gear 152. Thus, actuation of clutch 155 rotates gear 152 which rotates gear 153 and roller 133. Since belt 65 may be rotated continuously, driving power for strip advancing roller 133 is available upon demand. When clutch 155 is clutched, i.e., not rotating gear 152, rollers 133 and 134 are stationary and engage and hold strip material 33 therebetween so strip material is not withdrawn from reel 136 and may be tensioned for severing by the advance of sheet stack 16.

Strip material 33 is advanced when clutch 155 is unclutched, i.e., roller 134 is driven, between a rigid, transparent curved outer guide 170 (FIG. 4) and a flexible inner guide 172 both attached to frame 138. Each time that clutch 155 is unclutched, it remains unclutched for a sufficient time to index a predetermined length of strip material 33 which is long enough to wrap around the downstream edge 38 of the largest sheet set expected with substantial portions of the strip extending along the major surfaces 57, 58 of the sheet set. Outer guide 170 terminates above and slightly upstream of lower intermediate pulley 76 and turns the strip material 33 from roll 34 90° so it hangs in the path 24 of a sheet set 16 being advanced into strip inserter 30. Inner guide 172 comprises a flexible sheet 174 having an upstream end 175 fixed to frame 138 and a downstream free end 176. Sheet 174 is thin and flexes towards a serrated knife edge 178 also fixed to frame 138. When strip material 33 is hanging in the path 24 of an advancing sheet set, the strip material 33 and the sheet 174 are in the broken line positions illustrated in FIG. 4. Flexible sheet 174 is flexed towards knife edge 178 when strip material 33 is engaged by an advancing sheet set and held between rollers 133 and 134. Flexing continues until the strip material 33 is brought against and cut by knife edge 178, illustrated in FIG. 4 by the solid line positions of strip material 33 and sheet 174. Upon severing strip material 33 from roll 34 thereof, sheet 174 flexes back to the broken line position illustrated in FIG. 4.

Sheet sets 16 with strips 33*a* applied thereto are accumulated in accumulator 50. FIGS. 1-3 show diverter 52 in its lower position to direct sheet sets 16 to accumulator 50. System controller 56 provides a signal to a drive (not shown) for diverter 52 to move it to its upper position which directs sheets to a transporter section of strip inserter 30 defined by the down stream end of belts 62, 63, 65, 66 and 68, 69, and another three pairs of lower belts referenced generally by 178 in FIG. 2. Diverter 52 is located upstream of belts 178.

An out of strip material sensor 180 carried by frame 138 between rollers 132, 133 and reel 136 is coupled to system controller 56 to monitor whether sufficient strip material is left for the next folding operation. Strip supply sensor 182 carried by frame 138 adjacent reel 136 is coupled to system controller 56 to monitor when a predetermined amount of strip material has been withdrawn from the reel, e.g. ¾ of a full reel.

Strip material 33 preferably has a width close or equal to the width of intermediate upper and lower belts 65 and 66 which improves the folding action on strip material 33.

Figure 7:
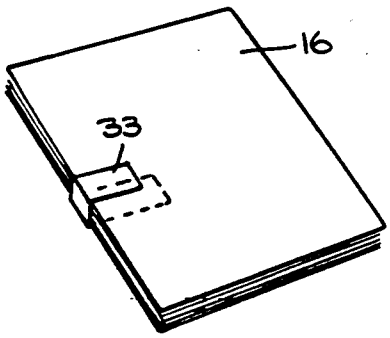
FIG. 7 is a top perspective view of a set of stack sheets to which a single folded strip has been applied in accordance with the invention to separate the set from other sets of stacked sheets.
Figure 8:
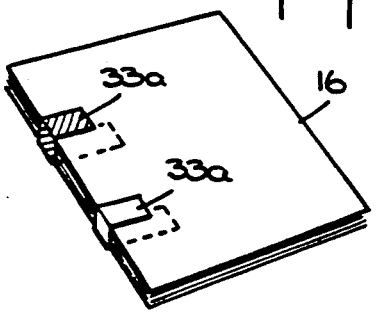
FIG. 8 is a top perspective view of a set of stack sheets to which a plurality of folded strips has been applied in accordance with the invention to separate the set from other sets of stacked sheets.

In accordance with the invention one or more strips 33*a* may be applied to sheet sets 16 as shown in FIGS. 7 and 8. The strips may be of any desired color or colors. Where more than one strip 33*a* is to be applied to a sheet set, a strip inserter 30*a* is provided which comprise a pair of folding nips 60 which are the same or similar to nip 60 described above.

Certain changes and modifications of the embodiments of the invention herein disclosed will be readily apparent to those of skill in the art. It is the applicants' intention to cover by the claims all such uses and all those changes and modifications which could be made to the embodiments of the invention herein chosen for the purposes of disclosure which do not depart from the spirit and scope of the invention.

What is claimed is:

1. Apparatus for applying a strip of material to a set of stacked sheets for separating that set from other sets, comprising:

a roll of said strip of material;

means for holding said strip in a path along which said sheet set is advanced;

means for advancing said sheet set towards and past said strip such that the downstream edge of said sheet set engages said strip with portions of said strip extending beyond first and second opposed major sides of said sheet set;

means for folding said strip at least once adjacent the downstream edge of said sheet set such that said strip portions extend generally adjacent said major sides; and means for advancing strip material from said roll into said path with a free end of said strip extending substantially beyond said first major side and a substantial portion of said strip connected to said roll extending beyond said second major side, and means for severing said substantial portion of said strip from said roll after said strip has been engaged by said sheet set downstream edge.

2. The apparatus of claim 1 wherein said folding means comprises a nip formed by a pair of rollers into which said sheet set downstream edge and said strip engaged thereby are advanced, said rollers engaging said strip and folding said strip adjacent said downstream edge of said sheet set as said sheet set is advances through said nip.

3. The apparatus of claim 2 comprising a roll of said strip material, means for advancing strip material from said roll into said path with a free end of said strip extending substantially beyond said first major side and a substantial portion of said strip connected to said roll extending substantially beyond said second major side, and means for severing said substantial portion of said strip from said roll after said strip has been engaged by said nip.

4. The apparatus of claim 3 wherein said severing means comprises a stationary knife edge positioned adjacent and spaced from said substantial portion of said strip when said strip is held in said path, and means for guiding said substantial portion of said strip against said knife edge as said strip is engaged by said rollers.

5. The apparatus of claim 4 wherein said guiding means comprises means for resiliently tensioning said strip as said strip is guided towards said knife edge.

6. The apparatus of claim 5 wherein said tensioning means comprises a flexible sheet along which said strip is advanced from said roll,.said flexible sheet being fixed at an upstream end thereof, a downstream end of said flexible sheet being free and movable towards said knife edge, said flexible sheet flexing towards said knife edge when said strip is advanced by its engagement with said advancing sheet set.

7. Apparatus for applying a strip of material from a roll thereof to a set of stacked sheets for separating that stacked set from other sets, comprising:

means for advancing said strip from said roll into a path along which said sheet set is advanced and holding said strip in said path with a free end of said strip extending substantially beyond a first major side of said stack and a substantial portion of said strip connected to said roll extending substantially beyond a second major side of said sheet set opposite said first major side;

means for advancing said sheet set in said path such that the downstream edge of said sheet set engages said strip between said strip free end and said substantial strip portion;

first and second rollers disposed to form a nip positioned in said path to receive said sheet set and said strip engaged thereby advanced by said sheet set advancing means, said rollers folding said strip at the downstream edge of each of said major sides as said sheet set and said engaged strip advance through said rollers; and means for severing said strip from said roll.

8. The apparatus of claim 7 comprising means for driving at least one of said rollers such that said rollers engage said sheet set and strip and at least assist in continuing the advance of said sheet set along said path.

9. The apparatus of claim 7 wherein said severing means comprises a stationary knife edge positioned adjacent and spaced from said substantial portion of said strip when said strip is held in said path, and means for guiding said substantial portion of said strip against said knife edge as said sheet set and said strip advance through said nip.

10. The apparatus of claim 9 wherein said guiding means comprises means for resiliently tensioning said strip as said strip is guided towards said knife edge.

11. The apparatus of claim 10 wherein said tensioning means comprises a flexible sheet along which said strip is advanced from said roll, said flexible sheet being fixed at an upstream end thereof, a downstream end of said flexible sheet being free and movable towards said knife edge, said flexible sheet flexing towards said knife edge as said sheet set and said strip advance through said rollers.

12. The apparatus of claim 7 wherein said first roller comprises a first pulley and a first belt passing around said first pulley, said apparatus comprising means for driving said first belt to thereby drive said first pulley, said first belt where it passes around said first pulley and said second roller forming said nip.

13. The apparatus of claim 12 comprising a second belt passing said second roller in generally tangential contact therewith, means for driving said second belt in synchronism with said first belt, said first belt where it passes around said first pulley and said second belt where it passes in tangential contact with said second roller forming said nip.

14. The apparatus of claim 13 comprising means for resiliently supporting said second roller for movement towards and away from said first pulley such that said second belt is resiliently held against said first belt but may be moved away therefrom, whereby said nip has a variable size opening thereto.

15. The apparatus of claim 7 wherein said strip advancing means comprises third and fourth rollers disposed to form a nip positioned to receive said strip material from said roll, said fourth roller being selectively driven.

16. The apparatus of claim 15 wherein said first roller comprises a first pulley and a first belt passing around said first pulley, said apparatus comprising means for driving said first belt to thereby drive said first pulley, wherein said first belt where it passes around said first pulley and said second roller form said nip, and comprising a fifth roller in contact with and driven by said belt and a selectively actuable clutch coupled to said fifth roller and to said fourth roller to selectively drive said fourth roller.

17. The apparatus of claim 16 wherein said clutch has an input shaft coupled to said fifth roller and an output shaft, and comprises means coupling said output shaft to a shaft on which said fourth roller is mounted.

18. A method for identifying sets of stacked sheets comprising:

holding a strip of sheet material in a path along which a set of stacked sheets and said strip are moved relative to each other;

advancing said strip from a roll thereof such that said strip has a free end extending substantially beyond a first major side of said sheet set and is attached to said roll substantially beyond a second major side of said sheet set;

relatively moving said sheet set and said held strip such that the downstream edge of said stack engages said strip with portions of said strip extending beyond opposed major sides of said sheet set;

severing said strip from said roll after said strip is engaged by said downstream edge of said sheet set; and applying said strip to said sheet set around said downstream edge of said sheet set with said strip portions extending generally adjacent said major sides as said sheet set and said strip relatively move past each other.

19. The method of claim 18 wherein said step of relatively moving comprises advancing said sheet set towards and past said strip.

20. The method of claim 19 wherein said step of applying comprises folding said strip at least once adjacent the downstream edge of said sheet set.

21. The method of claim 19 wherein said step of applying comprises folding said strip at the downstream edge of each of said major sides.

22. The method of claim 21 wherein said step of applying said strip comprises further advancing said sheet set and said strip engaged by the downstream edge thereof into the nip of opposed rollers such that said rollers fold said strip at each of said major sides.

23. The method of claim 22 comprising the step of driving at least one of said rollers.

24. The method of claim 19 wherein said step of applying said strip comprises further advancing said sheet set and said strip engaged by the downstream edge thereof into the nip of opposed rollers, at least one of which is driven, and wherein the step of severing said strip from said roll comprises drawing said strip across a cutter when said strip and sheet set downstream edge are engaged and advanced in said nip.

25. The method of claim 18 wherein the step of severing said strip from said roll comprises drawing said strip across a cutter when said strip and stack downstream edges are engaged and advanced in said nip.

26. A method of applying a strip of material from a roll thereof to a set of stacked sheets for separating that set from other sets, comprising:

advancing said strip from said roll into a path along which said sheet set is being advanced and holding said strip in said path with a free end of said strip extending substantially beyond a first major side of said sheet set and a substantial portion of said strip connected to said roll extending substantially beyond a second major side of said sheet set opposite said first major side;

advancing said sheet set of sheets in said path such that the downstream edge of said sheet set engages said strip with said strip portions extending beyond said first and second opposed major sides of said sheet set;

further advancing said sheet set and said strip engaged by the downstream edge thereof into the nip of opposed rollers, such that said rollers fold said strip at each of said major sides; and severing said strip from said roll.

* * * * *